United States Patent [19]

Scheck et al.

[11] Patent Number: 4,593,928

[45] Date of Patent: Jun. 10, 1986

[54] SAFETY TOE UNIT FOR A SKI BINDING

[75] Inventors: Georg Scheck, Leonberg; Martin Bogner, Ostfildern, both of Fed. Rep. of Germany

[73] Assignee: Geze GmbH, Leonberg, Fed. Rep. of Germany

[21] Appl. No.: 659,437

[22] Filed: Oct. 10, 1984

[30] Foreign Application Priority Data

Oct. 19, 1983 [DE] Fed. Rep. of Germany ..... 3337993

[51] Int. Cl.[4] ..... A63C 9/08

[52] U.S. Cl. ..... 280/625; 280/629

[58] Field of Search ..... 280/625, 623, 629, 634, 280/630, 626

[56] References Cited

U.S. PATENT DOCUMENTS 3,822,071 7/1974 Mottet ..... 280/625
4,088,343 5/1978 Krob ..... 280/625

FOREIGN PATENT DOCUMENTS 2224410 12/1972 Fed. Rep. of Germany ..... 280/625
1966462 4/1973 Fed. Rep. of Germany ..... 280/625
2616344 4/1976 Fed. Rep. of Germany ..... 280/625

*Primary Examiner*—John J. Love
*Assistant Examiner*—Michael Mar

[57] ABSTRACT

A safety toe unit for a ski binding has two sole retaining jaws (11, 12) which can pivot laterally outwards in opposite directions. A respective projection (13, 14) of a pressure member (19) acts on each of the sole retaining jaws at the front between the pivot axes (15, 16) and shoe retaining rollers (17, 18). The pressure member (19) is arranged for displacement in the longitudinal direction of the ski substantially in front of the sole retaining jaws (11, 12) and is urged in a rearward direction by a compression spring (21) which is braced against a housing (20) which in operation is secured to the ski. The two pivot axes (15, 16) which are spaced by a small transverse distance (A) from the central longitudinal plane (22) are tilted slightly inwardly towards the vertical and central longitudinal axis (22). The pressure member (19) has an extension (24) which extends forwardly inside the coil spring (21) and which is journalled by means of a ball-shaped head (24') in an elongate guide sleeve (26).

13 Claims, 3 Drawing Figures

SAFETY TOE UNIT FOR A SKI BINDING

Figure 1:
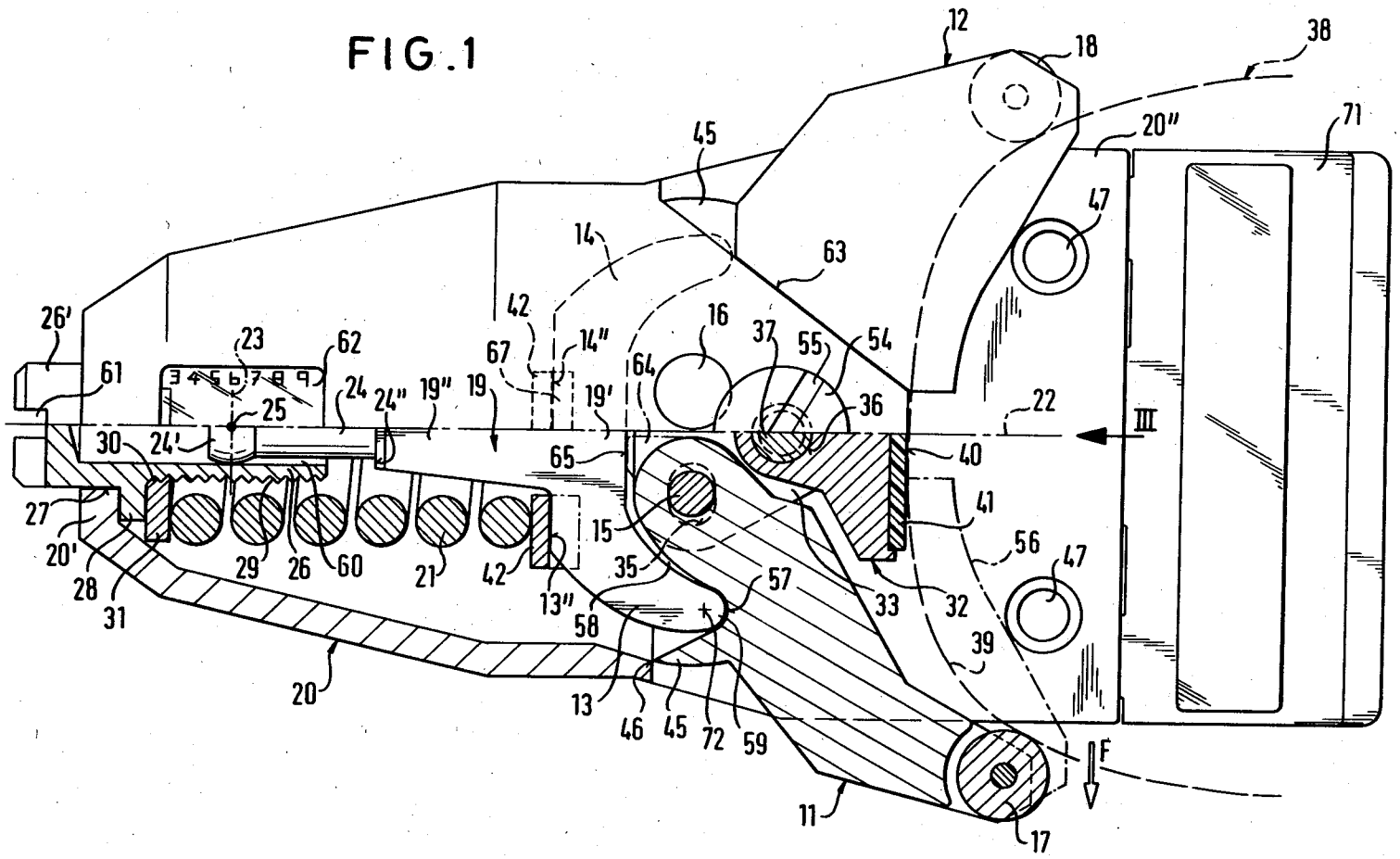

The invention relates to a safety toe unit for a ski binding comprising two sole retaining jaws which can pivot laterally outwards in opposite directions, with respective projections of a pressure member acting on the sole retaining jaws at the front between the pivot axes and the ski boot retaining points, and with the pressure member being displaceably arranged in the longitudinal direction of the ski substantially in front of the sole retaining jaws and being urged rearwards by a compression spring which is braced against a housing which can be secured to the ski.

Safety toe units of this kind are known from German laying open print DE-OS No. 26 16 344 and generally cooperate with a safety heel unit which resiliently presses the ski boot forwardly in the longitudinal direction of the ski against the toe unit. As a result the two sole retaining jaws of the toe unit are generally spread sideways by a certain amount against the force of the spring until the front edge of the sole of the ski boot is braced against an abutment present on the sole retaining jaws, or more preferably on the binding housing or the base plate, against the thrust originating from the heel.

In the previously known safety toe units (DE-OS No. 26 16 344) the two sole retaining jaws are arranged for sideways pivotal movement on a common vertical and central axle. The sole retaining jaws are of relatively complicated construction and the danger exists during sideways release that troublefree release is prevented by too much friction between the sole retaining jaws and the sole of the ski boot.

In order to avoid jamming of the ski boot during sideways pivotal movement of the sole retaining jaws it is already known from German laying open print DE-OS No. 22 24 410 to tilt the pivot axes slightly inwardly relative to a vertical and central longitudinal plane. The problem however exists here that the abutment surfaces which resiliently act on the sole retaining jaws have to execute small vertical movements relative to the countersurfaces on the sole retaining jaws during sideways release which is only possible by overcoming considerable frictional forces, which however likewise impair the release procedure.

The principal object underlying the invention is thus to provide a safety toe unit of the initially named kind in which the release procedure is not hindered either by excess friction between the sole retaining jaws and the ski boot or by relative movement against frictional forces between the pressure member and the sole retaining jaws. The binding should be of simple and compact construction, should be easy and economical to manufacture and should moreover operate extremely reliably in rough everyday use. Moreover, the safety toe unit should be substantially insensitive to icing and intervening layers of snow.

In order to satisfy this object the invention provides that the two pivot axes are laterally spaced from the vertical and central longitudinal plane on opposite sides thereof and are slightly tilted inwards towards said plane; in that the pressure member has a forwardly directed extension within the compression spring; and in that the extension is mounted in the end region remote from the sole retaining jaws for displacement in the longitudinal direction of the ski and is mounted at the housing for small tilting movements about a transverse tilting axis.

Thus, in accordance with the invention, the pressure member should have sufficient space for movement or play in the region of the sole retaining jaws, at least in the vertical direction, so that it can readily follow the vertical components of movement of the sole retaining jaws which occur during sideways release as a result of the inclined axes. The pressure member is however axially and tiltably guided by its forwardly directed extension in the indicated manner in order that it still ensures troublefree straight-line guidance of the pressure member when one of the projections separates from the associated countersurface on the associated sole retaining jaw. As the pressure member also generally moves sideways during sideways release the front end region of the projection should also be mounted at the housing for small tilting movements about a vertical tilting axis.

It is most expedient for the two tilting axes to intersect in the central longitudinal plane. This can for example be constructionally realised if the front end region of the extension is ball-shaped and is slidably seated in an elongate guide sleeve secured to the housing. the elongate guide sleeve must be so supported at the housing that it can transfer the countermoment to the extension during sideways pivotal movement of a sole retaining jaw which is necessary in order to retain the pressure member in its normal position, which corresponds to the rest position.

As the extension is made longer the forces which act on the guide for the sliding movement become lower and the release procedure is less impaired by the support, in accordance with the invention, of the pressure member in the elongate guide sleeve.

It is particularly advantageous if the elongate guide sleeve passes through a central bore in the front wall of the housing, is braced at its front end at the front wall, in particular by a flange, and carries, via an external thread, a spring abutment for the front end of the compression spring, with the spring abutment having an internal thread complementary to the external thread. In this case the elongate guide sleeve executes a double function in that it simultaneously permits adjustment of the bias of the compression spring, which is normally formed as a coil spring, without the elongate guide sleeve which is provided for the adjustment being axially displaced relative to the housing as a result of the adjustment. For the purpose of adjustment the elongate guide sleeve expediently has a screw driver slot at its external end face.

A further advantageous embodiment is characterised in that a spring abutment is provided on the pressure member for the end of the compression spring which acts thereon, with the abutment being loaded against the action of the force of the compression spring by a compensator for the pressure at the ball region of the ski boot. The spring abutment which acts on the pressure member can thus be additionally exploited to compensate for the pressure at the ball region of the ski boot in advantageous manner.

The invention is also intended to provide a safety toe unit of the initially named kind by means of which the sole retaining jaws can be vertically adjusted to match them to different sole thicknesses in a simple manner which is constructionally easy to realise.

For this purpose the invention provides that the sole retaining jaws are displaceably arranged on tilted axles secured to the housing for movement in the longitudinal direction thereof, with said tilted axles defining said tilted pivot axes, and with said sole retaining jaws being held in a desired vertical position by a vertical adjustment member which can be vertically adjusted relative to the housing. The invention thus additionally exploits the pivot axles for vertical adjustment in as much as the sole retaining jaws are displaceable on the pivot axles in the vertical direction. An appropriate amount of space must be provided within the housing for the displacement of the parts of the sole retaining jaws which are located there.

The vertical adjustment member preferably has lateral projections which engage in transverse slots in the sole retaining jaws. Bores within the projections preferably surround the pivot axles with play.

If the slightly inwardly tilted pivot axles are used then the transverse slots and the projections should extend perpendicular to the associated tilted pivot axles. In order to avoid the danger of jamming of the vertical adjustment member on the pivot axles in this case a further embodiment is constructed so that the projections have transversely extending elongate slots the width of which corresponds approximately to the diameter of the tilted pivot axles, and so that the tilted pivot axles extend through these elongate slots. The sideways play in the elongate slots should be so dimensioned that the vertical adjustment member can be freely adjusted upwardly or downwardly unhindered by the pivot axles in all vertical positions and without jamming occurring.

In order to practically realise the vertical adjustment of the vertical adjustment member a vertically threaded bore can extend centrally through the vertical adjustment member and can receive an adjustment screw which is rotatably mounted on the housing but secured against vertical movement. The adjustment screw projects through a bore upwardly preferably out of the binding housing and has there a screwdriver slot for the engagement of an adjustment tool.

The vertical adjustment member can, in accordance with the invention, fulfil a further function if it has a front support surface which faces the sole of the ski boot with the front end of the sole of the ski boot being braced against the front support surface against the thrust acting from the rear. The front support surface is preferably formed on a slide plate (anti-friction plate) which extends perpendicular to the central longitudinal plane, which is secured to the vertical adjustment member and which for example consists of polytetrafluoro ethelene.

With safety toe units with tilted axes the problem also exists that during sideways release only the sole retaining jaw which swings sideways moves with a specific vertical component, not however the other sole retaining jaw which remains in its rest position. The invention is also intended to provide help in this respect and to suggest a solution which avoids jamming of the sole of the ski shoe on the sole retaining jaw which remains stationary during sideways release.

For this purpose the lower sole support surfaces of the sole retaining jaws are inclined slightly upwardly from the outside towards the inside, with the angle of inclination relative to the horizontal amounting to from 4 to 8° and in particular to approximately 6°.

If now the ski boot pivots to one side together with one sole retaining jaw and moves with a vertical component then it will not be hindered in so doing by the sole retaining jaw which remains in its rest position, because of the relevant inclination. Thus, in accordance with the invention, the inclination of the lower sole support surface of the sole retaining jaws should be arranged in accordance with the tilted position of the pivot axles in such a way that the vertical components of movement of one sole retaining jaw so correspond with the inclined rise of the lower support surface that the sole of the ski boot remains in a substantially horizontal position during sideways release as viewed in the transverse direction.

Finally, the invention is intended to avoid, in simple manner, the penetration of snow or contamination into the interior of the binding without requiring expensive sealing sleeves or the like for this purpose. To this end the invention provides that the sole retaining jaws have lateral projections in the form of sections of a cylinder the axes of which coincide with the pivot axes; and in that the cylindrical projections cooperate with sealing edges or surfaces of the housing.

Figure 2:
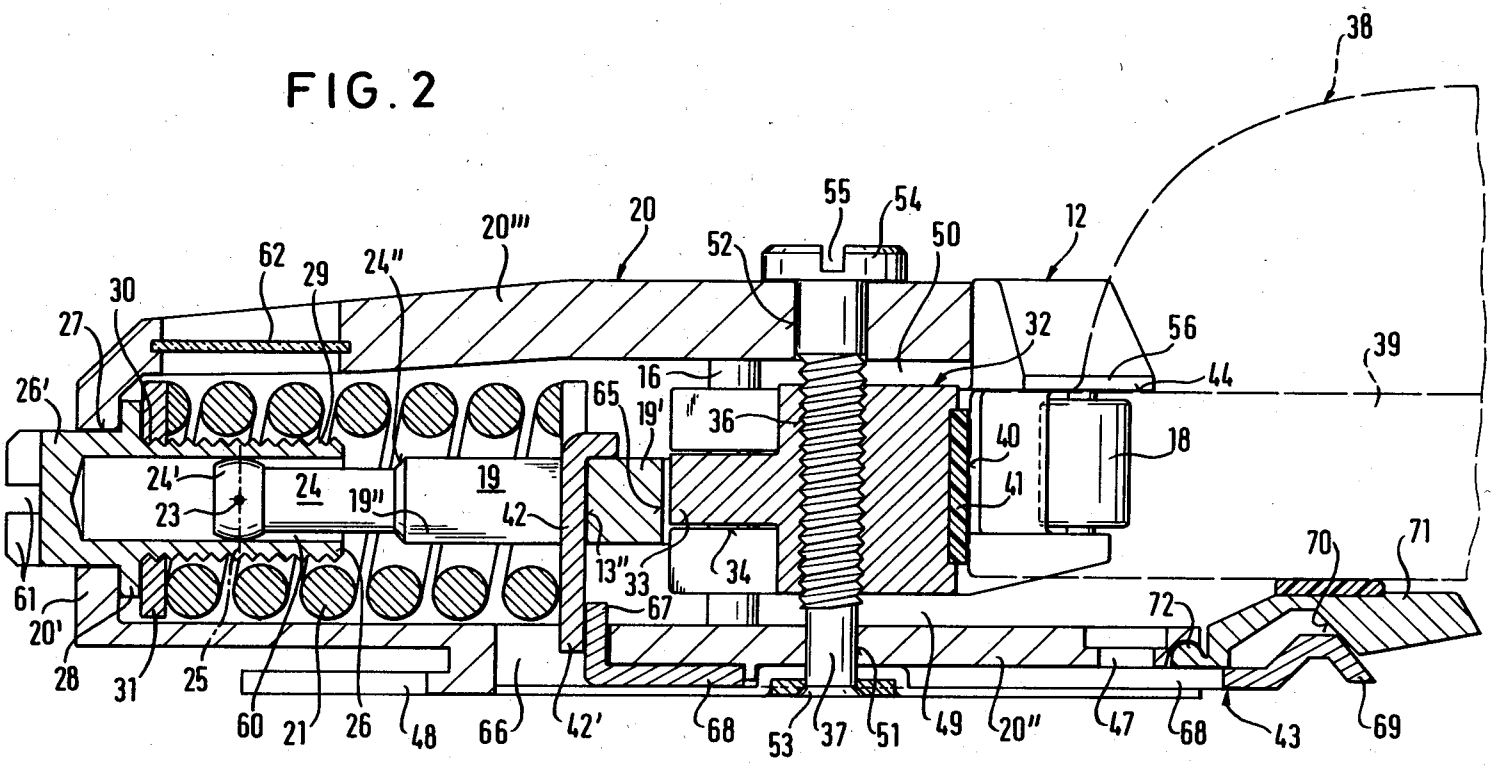
Figure 3:
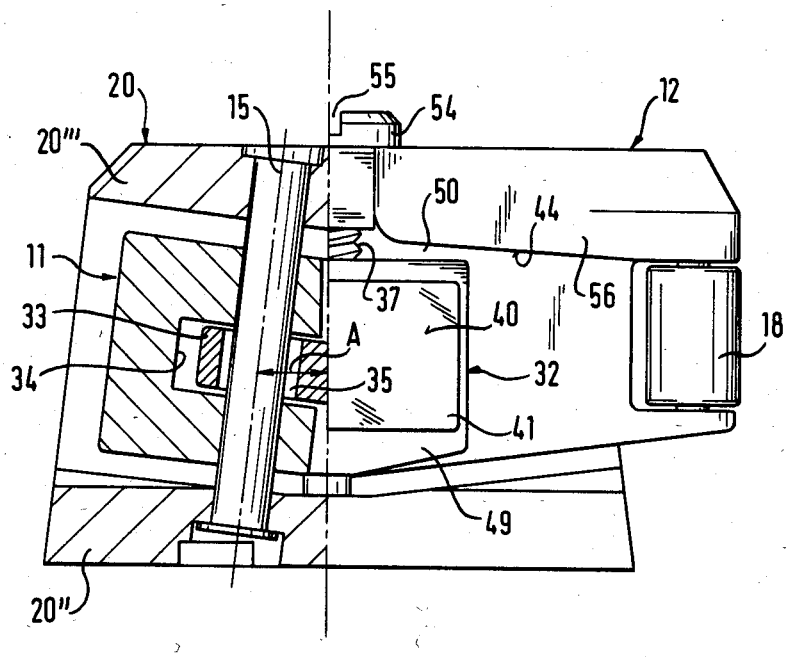

The invention will now be described in more detail in the following by way of example only and with reference to the drawings which show:

FIG. 1 a schematic plan view of a safety toe unit in accordance with the invention with sections at different levels being reproduced to the right and to the left of the central longitudinal plane, FIG. 2 a partially sectioned side view of the arrangement of FIG. 1 as seen from the left, and FIG. 3 a partly sectioned view of the safety toe unit of the invention as seen in the direction of the arrow III of FIG. 1.

As seen in the drawings the safety toe unit of the invention has a binding housing 20 which can be secured to a non-illustrated ski via screw holes 47 provided in a base plate 20'' fixed to the housing and via a mounting slot 48, by means of screws which can be screwed into the ski and mounting devices mounted on the screws respectively. The housing 20 is thus to be regarded as fixed to the ski.

As seen in FIGS. 1 and 3 pivot axles 15, 16 extend between the upper wall 20''' and the base plate 20'' and are tilted inwardly at an angle of approximately 6.5° relative to the vertical so that they progressively approach the central longitudinal plane 22 when going from the bottom to the top of the pivot axles. The means spacing A of the pivot axles 15, 16 from the central longitudinal plane 22 amounts, in accordance with the invention, to from 5 to 9 and in particular to approximately 7 mm. The pivot axles 15, 16 are thus arranged relatively closes to the central longitudinal plane 22 and completely symmetrically on both sides thereof.

Sole retaining jaws 11, 12 are pivotably mounted on the pivot axles 15, 16 and can be displaced in the longitudinal direction of the pivot axles 15, 16. In order to locate the two sole retaining jaws 11, 12 in the vertical direction a vertical adjustment member 32 is arranged between them which, in accordance with FIG. 3, is arranged between the upper wall 20''' and the base plate 20'' of the housing with appropriate play 49, 50 for adjustment. The adjustment member 32 is provided with a vertical threaded bore 36 arranged on the central longitudinal plane. An adjustment screw 37 provided with an external thread extends through this vertical threaded bore and has thread-free regions which extend through bores 51, 52 in the base plate 20'' and in the upper wall 20''' of the housing 20 respectively. The adjustment screw 37 is secured in the vertical direction by heads 53 and 54 at the lower and upper ends respectively which respectively contact the base plate 20'' and the upper wall 20'''.

By inserting a screwdriver in a screwdriver slot 55 in the upwardly projecting head 55 of the adjustment screw 37 the latter can be turned in one direction or the other, whereby the vertical adjustment member 32 can be displaced in the vertical direction.

As seen in FIGS. 1 and 3 abutments 33 with mutually parallel upper and lower flat surfaces extend in the front region of the vertical adjustment member 32 in complementary transverse slots 34 inside the sole retaining jaws 11, 12 with the projections 33 and the transverse slots 34 extending perpendicular to the pivot axles 15, 16.

Inside the projections 33 there are provided transversely extending elongate slots 35 through which the pivot axles 15, 16 pass and which have a width the same as the diameter of the pivot axles (FIG. 1).

On vertical adjustment of the vertical adjustment member 32 as a result of rotation of the adjustment screw 37 the sole retaining jaws 11, 12 are displaced upwardly or downwardly on their pivot axles 15, 16 and the pivot axles 15, 16 move, as a result of their inclined position within the elongate slots 35, laterally in one direction or the other.

On the side facing the ski boot 38 which is illustrated in broken lines the vertical adjustment member 32 is provided with a slide plate 41 which stands perpendicular to the vertical central longitudinal plane 22 and which represents a front support surface 40 for the sole 39 of the ski boot 38. Shoe retaining rollers 17, 18 which are rotatable about vertical axes are provided at the side ends of the sole retaining jaws 11, 12 in the region where the sole 39 of the ski boot passes via its curved side surface from the front part into the side part. The shoe retaining rollers 17, 18 are covered by a wall 56 which engages over the sole 39 of the ski boot and holds the sole down.

As seen in FIG. 3 (right hand half) the lower sole support surface 44 of the hold-down wall 56 for the sole of the ski boot is of inclined construction as seen from the rear in such a way that it climbs slightly by an angle of approximately 6°, starting from the shoe retaining rollers 17, 18, from the outside to the inside. The upward slope of the lower surface 44 corresponds to the inclined angle of the pivot axles 15, 16.

As seen in FIGS. 1 and 2, the sole retaining jaws or sole clamps 11, 12 are provided at the outside, adjacent the pivot axle 15, 16 with approximately circular recesses 57 which are located at the bases of lateral pockets 58 which are provided on the front sides of the sole retaining jaws 11, 12 between the pivot axles 15, 16 and the shoe support rollers 17, 18 relatively close to the pivot axles 15, 16. Projections 13, 14 of a pressure member 19 project from the front into these pockets 58 with the lobes 59 of the projections being complementary in shape to the recesses 57, but of somewhat greater curvature than the latter, and with the lobes 59 contacting the pockets 58.

The projections 13, 14 merge over an arc of approximately 90° into a central web 19' of the pressure member 19 which in the same way as the projections 13, 14, is completely symmetrically constructed relative to the central longitudinal plane 22. A conically tapering extension 19 extends forwardly from the central web 19' of the pressure member 19 and merges via a step 24'' into a cylindrical extension 24 of reduced diameter which is provided with ball-shaped head 24' at its front end. This ball-shaped head is axially slidably seated inside an elongate guide sleeve 26 and is journalled for small tilting movements about a transverse tilting axis 23 and also about a vertical tilting axis 25. A considerable clearance 60 is provided between the cylindrical part of the projection 24 and the inner wall of the elongate sleeve 26 and ensures the required degree of freedom during sideways release or vertical adjustment of the binding. The step 24'' is located at a distance from the elongate guide sleeve 26 such that even with the largest possible sideways deflection of one sole retaining jaw it does not touch the elongate guide sleeve 26 or at most just touches it.

The elongate guide sleeve 26 extends through a bore 27 in the front wall 20' of the binding housing 20 and terminates there in a head 26' which bears a screw driver slot 61. The elongate guide sleeve can be rotated about its longitudinal axis by inserting a screw driver into the slot 61, with the ball-shaped head 24' however retaining its position.

A flange 28 projects radially from the elongate guide sleeve 26 at the rear side of the front wall 20' and braces the elongate guide sleeve 26 at the front end against the housing 20. At the opposite side from the front wall 20' a spring abutment 31 having an internal thread 30 contacts the flange 28 and is threaded onto an external thread 29 provided on the elongate guide sleeve 26. The spring abutment 31 is of non-round cross-section, and is preferably square or rectangular and arranged in a corresponding square or rectangular opening of the housing 26 in such a way that the spring abutment 31 is secured against rotation but can however be displaced in the longitudinal direction of the ski.

A window 62 is located above the spring abutment 31 through which the spring abutment 31, or a pointer secured thereto, is visible. In this way the spring bias can be made outwardly visible by means of a numbered scale.

A compression coil spring 21 is arranged around the elongate guide sleeve 26, the projection 24 and also the conical part 19'' and is braced at the front end via the spring abutment 31 and the flange 28 against the housing 20 and at the rear end against a further spring abutment 42 which contacts the abutment 13'', 14'' of the projections 13, 14 of the central web 19' of the pressure member 19 from the front and thus resiliently biases the pressure member 19 in the direction towards the ski boot 38. In this manner a bias force is exerted which pivots the sole retaining jaws 11, 12 into their rest position.

As seen in FIG. 1 the sole retaining jaws 11, 12 contact the support surfaces 63 of the housing 20 in their rest position. It is however also possible for the sole retaining jaws to have projections 64 which project inwardly beyond the pivot axles 15, 16 and which come axially into contact with support surfaces 65 of the pressure member 19 close to the vertical and central longitudinal plane 22 in order to define the rest position of the sole retaining jaws 11, 12 in this way when no ski boot is present in the binding.

Cylindrical projections 45 are provided on the sole retaining jaws 11, 12 externally, lateraly outside of the recesses 57, with the central axes of these cylindrical projections coinciding with the pivot axes 15 and 16 respectively. These cylindrical projections cooperate with sealing edges 46 at the sidewalls of the housing 20 in such a way that on outward pivotal movement of one of the sole retaining jaws the corresponding cylindrical wall of the associated projection 45 slides along the sealing edge 46 and thus protects the interior of the housing 20 against the penetration of contamination or snow.

The spring abutment 42 has a projection 42' which extends downwardly into an opening 66 of the base plate 20" and which is engaged at the rear by an abutment 67 which branches vertically upwardly from a thrust rod member 68. The thrust rod member 68 passes around both sides of the adjustment screw 37 in the manner which is not illustrated in the drawing.

The thrust rod member 68 extends rearwardly behind the sole retaining jaws 11, 12 into the ball region of the sole 29 of the ski boot and terminates there in an element 69 with an inclined surface which is acted on by a foot plate 71 which is provided with a corresponding inclined surface 70. The foot plate 71 is pivotally mounted at 72 about a transverse axis. By depressing the foot plate 71 a forwardly directed force is transmitted to the thrust rod member 68 which acts via the projection 42' on the spring abutment 42 in a sense which reduces the spring bias on the pressure member 19. In this way the release can be made more or less easy depending on the pressure exerted on the foot plate 71 by the ball region of the sole 39 of the ski boot.

The safety toe unit of the invention operates as follows:

The desired spring bias 21 is first set by rotating the elongate guide sleeve 26. The correct height for the sole retaining jaws 11, 12 is then selected by rotating the adjustment screw 37.

If a ski boot 38 is now inserted into the binding in accordance with FIGS. 1 and 2 then the sole retaining jaws 11, 12 are spread apart under the thrust of the non-illustrated heel unit by contact of the sole 39 of the ski boot with the ski boot support rollers 17, 18 until the front surface of the sole 29 of the ski boot comes into contact with the front support surface 40.

During sideways release, for example in the direction of the arrow F of FIG. 1, the sole retaining jaw 11 pivots outwardly to the left provided the release force specified by the bias of the spring 21 is exceeded. The outwardly pivoting sole retaining jaw now presses the pressure member 19 forwardly, via the recess 57 and projection 13, with the spring 21 being compressed and with the ball-shaped head 24' being displaced forwardly inside the elongate guide sleeve 26. Although the pivot axis 72 (FIG. 1) between the sole retaining jaw 11 and the projection 13 is located almost transversely in line with the pivot axis 15 a slight pivotal movement of the pressure member 19 takes place during this sideways pivotal movement about the vertical axis 25 which is however possible without notable frictional resistance as a result of the ball-shaped construction of the head 24' and the clearance 60.

During the outward pivotal movement of the sole retaining jaw 11 the recess 57 however also moves with a slight vertical component so that the projection 13 is also moved somewhat upwardly. This movement is also possible without frictional movement between the lobe 59 and the recess 57 because the pressure member 19 can now pivot somewhat about the transverse axis 23. At the same time the ball-shaped head 24' is also displaced in the axial direction inside the elongate guide sleeve 26. As a result a troublefree longitudinal guidance of the pressure member 19 is ensured although the projection 14 which is only illustrated in broken lines in FIG. 1 is lifted out of the associated recess in the sole retaining jaw 12, i.e. is no longer supported thereby.

During outward pivotal movement of the sole retaining jaw 11 the lower sole support surface 44 moves upwardly and indeed in accordance with the tilted position of the pivot axle 15. The shoe is not prevented from making this slight upward movement by the right hand sole retaining jaw 12 because the lower sole support surface 44 of the right hand sole retaining jaw 12 likewise extends obliquely upwardly.

We claim:

1. A safety toe unit for a ski binding comprising two sole retaining jaws each having a ski boot retaining point, a pivot axis about which each jaw can pivot laterally outwards, said jaws pivoting in opposite directions, a pressure member having a pair of projections which respectively act on a respective sole retaining jaw at the front between the pivot axis and the ski boot retaining point thereof, said pressure member being displaceably arranged in the longitudinal direction of the ski substantially in front of the sole retaining jaws, a compression spring, and a housing which is securable to the ski and against which said compression spring is braced, said pressure member being urged rearwards by said compression spring, characterized in that said pivot axes are laterally spaced from a vertical and central longitudinal plane (22) of said unit on opposite sides thereof and are slightly tilted inwards towards said plane (22), said pressure member (19) has a forwardly directed extension (19", 24", 24) within the compression spring (21), and an elongated guide sleeve (26) is secured to the housing (20), the front end region (24) of the extension (19", 24", 24) being ball-shaped (24') and slidably seated in said sleeve, said extension being mounted in the end region of the unit remote from the sole retaining jaws (11,12) for displacement in the longitudinal direction of the ski and being mounted on the housing for small tilting movements about a transverse tilting axis (23), and the front end region of the extension being also mounted on the housing (20) for small tilting movements about a vertical tilting axis (25), the two tilting axes (23,25) intersecting in the central longitudinal plane (22).

2. A safety toe unit in accordance with claim 1, characterised in that the elongate guide sleeve (26) passes through a central bore (27) in the front wall (20') of the housing (20), is braced at its front end at the front wall (20'), in particular by a flange (28), and carries, via an external thread (29), a spring abutment (31) for the front end of the compression spring (21), with the spring abutment (31) having an internal thread (30) complementary to the external thread (29).

3. A safety toe unit, in particular in accordane with claim 1, characterised in that a lower sole support surface (44) of the sole retaining jaws (11, 12) is inclined slightly upwardly from the outside towards the inside.

4. A safety toe unit in accordance with claim 3, characterised in that the inclination relative to the horizontal amounts to from 4° to 8° and in particular to approximately 6°, and preferably corresponds to the inclination of the pivot axes (15, 16).

5. A safety toe unit, in particular in accordance with claim 1, characterised in that the sole retaining jaws (11, 12) have lateral projections (45) in the form of sections of a cylinder the axes of which coincide with the pivot axes; and in that the cylindrical projections cooperate with sealing edges or surfaces (46) of the housing (20).

6. A safety toe unit for a ski binding comprising two sole retaining jaws each having a ski boot retaining point, a pivot axis about which each jaw can pivot laterally outwards, said jaws pivoting in opposite directions, a pressure member having a pair of projections which respectively act on a respective sole retaining jaw at the front between the pivot axis and the ski boot retaining point thereof, said pressure member being displaceably arranged in the longitudinal direction of the ski substantially in front of the sole retaining jaws, a compression spring, and a housing which is securable to the ski and against which said compression spring is braced, said pressure member being urged rearwards by said compression spring, characterized in that said pivot axes are laterally spaced from a vertical and central longitudinal plane (22) of said unit on opposite sides thereof and are slightly tilted inwards towards said plane (22), said pressure member (19) has a forwardly directed extension (19", 24", 24) within the compression spring (21), a spring abutment (42) is provided on the pressure member (19) for an end of the compression spring (21) which acts thereon, and a compensator (43) for the pressure at the ball region of the ski boot is provided for loading the abutment against the action of the force of the compression spring (21), said extension being mounted in the end region of the unit remote from the sole retaining jaws (11, 12) for displacement in the longitudinal direction of the ski and being mounted on the housing for small tilting movements about a transverse tilting axis (23).

7. A safety toe unit for a ski binding comprising two sole retaining jaws each having a ski boot retaining point, a pivot axis about which each jaw can pivot laterally outwards, said jaws pivoting in opposite directions, a pressure member having a pair of projections which respectively act on a respective sole retaining jaw at the front between the pivot axis and the ski boot retaining point thereof, said pressure member being displaceably arranged in the longitudinal direction of the ski substantially in front of the sole retaining jaws, a compression spring, and a housing which is securable to the ski and against which said compression spring is braced, said pressure member being urged rearwards by said compression spring, characterized in that the sole retaining jaws (11, 12) are displaceably arranged on tilted axles (15,16) secured to the housing (20) for movement in the longitudinal direction thereof, with said tilted axles defining said pivot axes, a vertical adjustment member (32) is provided for holding said sole retaining jaws in a desired vertical position, said vertical adjustment member (32) being vertically adjustable relative to the housing (20), said pivot axles are laterally spaced from a vertical and central longitudinal plane (22) of said unit on opposite sides thereof and are slightly tilted inwards towards said plane (22), said pressure member (19) has a forwardly directed extension (19", 24", 24) within the compression spring (21), said extension being mounted in the end region of the unit remote from the sole retaining jaws (11, 12) for displacement in the longitudinal direction of the ski and being mounted on the housing for small tilting movements about a transverse tilting axis (23).

8. A safety toe unit in accordance with claim 7, characterised in that the vertical adjustment member (32) is provided with lateral projections (33) which engagae in transverse slots (34) of the sole retaining jaws (11,12).

9. A safety toe unit in accordance with claim 8, characterised in that the transverse slots (34) and the projections (33) extend perpendicular to the associated tilted pivot axles (15, 16).

10. A safety toe unit in accordance with claim 8, characterised in that the projections (33) have transversely extending elongate slots (35) the width of which corresponds approximately to the diameter of the tilted pivot axles (15, 16); and in that the tilted pivot axles (15, 16) extend through these elongate slots.

11. A safety toe unit in accordance with claim 7, characterised in that a vertically threaded bore (36) extends centrally through the vertical adjustment member (32) and receives an adjustment screw (37) which is rotatably mounted on the housing (20) but secured against vertical movement.

12. A safety toe unit in accordance with claim 7, characterised in that the vertical adjustment member (32) has a front support surface (40) which faces the sole (39) of the ski boot.

13. A safety toe unit in accordance with claim 12, characterised in that the front support surface (40) is formed on a slide plate (41) which extends perpendicular to the central longitudinal plane (22) and which is secured to the vertical adjustment member (32).

* * * * *